US006444274B2

(12) United States Patent
Görbig

(10) Patent No.: US 6,444,274 B2
(45) Date of Patent: Sep. 3, 2002

(54) PRODUCTION OF ANTIADHESIVE COATINGS ON WEB FORM SUBSTRATES

(75) Inventor: Olaf Görbig, Hamburg (DE)

(73) Assignee: tesa AG, Hamburg (DE)

( * ) Notice: Subject to any disclaimer, the term of this patent is extended or adjusted under 35 U.S.C. 154(b) by 0 days.

(21) Appl. No.: 09/790,306

(22) Filed: Feb. 22, 2001

(30) Foreign Application Priority Data

Mar. 1, 2000 (DE) ..... 100 09 856

(51) Int. Cl.[7] ..... C08J 7/18

(52) U.S. Cl. ..... 427/489; 427/177; 427/179; 427/244; 427/255.23; 427/255.5; 427/255.6; 427/294; 427/296; 427/488; 427/490; 427/491; 427/569; 427/578; 427/580

(58) Field of Search ..... 427/488–491, 427/569, 578, 580, 177, 179, 244, 255.23, 255.5, 255.6, 294, 296

(56) References Cited

U.S. PATENT DOCUMENTS 5,112,025 A 5/1992 Nakayama et al. ..... 249/115

FOREIGN PATENT DOCUMENTS

EP 0 841 140 5/1998 ..... B29C/33/56

*Primary Examiner*—Bernard Pianalto
(74) *Attorney, Agent, or Firm*—Norris McLaughlin & Marcus

(57) ABSTRACT

A process for producing antiadhesive layers on a web-form material, characterized in that the antiadhesive layers are applied to the web-form material by means of low pressure plasma polymerization by guiding the web-form material continuously through a plasma zone containing a low pressure plasma.

8 Claims, 2 Drawing Sheets

PRODUCTION OF ANTIADHESIVE COATINGS ON WEB FORM SUBSTRATES

The invention relates to a process for producing antiadhesive coatings on a webform material and to the use of the antiadhesive coatings, especially in connection with adhesive tapes.

Layers which are antiadhesive with respect to pressure-sensitive adhesive compositions are used on web-form materials, such as on adhesive tapes or release materials, for example, in order to achieve sufficient reversibility of an adhesive bond. In the case of adhesive tapes this is often particularly problematic, since in general specific release forces and residueless detachment between adhesive composition and backing reverse face or release material are required. Moreover, the intention in many cases is that no transfer material, especially no transfer of silicone, is to take place to the adhesive composition from the coating which is antiadhesive with respect to pressure-sensitive adhesive compositions.

To produce layers which are antiadhesive with respect to pressure-sensitive adhesive compositions on web-form materials, especially to reverse faces of adhesive tapes, a variety of processes are used.

Layers which are antiadhesive with respect to pressure-sensitive adhesive compositions may be applied, for example, in the form of a wet-chemical coating from solution (solvent or water), in which case subsequent drying and/or crosslinking is needed. This crosslinking may be carried out, for example, thermally or by radiation.

The disadvantages of the conventional processes for applying layers which are antiadhesive with respect to pressure-sensitive adhesive compositions are in particular that in many cases solvents are used.

The use of wet-chemically applied layers which are antiadhesive with respect to pressure-sensitive adhesive compositions generally entails high costs, since the furnishing of the wet-form material with a primer constitutes a complete additional coating operation. Moreover, certain layers which are antiadhesive with respect to pressure-sensitive adhesive compositions must be classified as objectionable from environmental and health standpoints, especially since solvents are needed for the wet-chemical coating.

A further problem exists when a certain release force, for example that of an adhesive film to its own reverse face, can be economically achieved with none of the known processes.

Furthermore, the layers thus produced which are antiadhesive with respect to pressure-sensitive adhesive compositions generally exhibit a transfer of material to the adhesive composition which comes into contact with them.

Low pressure plasma polymerization is not employed for producing, on web-form materials, layers which are antiadhesive with respect to pressure-sensitive adhesive compositions, despite the fact that a large number of different applications already exist for similar low pressure plasma processes. Examples are the coating of plastic bottles with permeation barrier layers, and the scratchproof coating of plastics surfaces.

It is an object of the invention to prevent or at least lessen the disadvantages of the prior art. A particular object of the invention is to achieve a marked reduction in adhesion of adhesive compositions to the surface of web-form materials intended for producing adhesive tapes or release materials, subject to the provisos that the reduction in adhesion must possess long-term stability and must not involve the use of any solvents and that the process and the layers which are antiadhesive with respect to pressure-sensitive adhesive compositions are unobjectionable from health and environmental standpoints and do not involve any transfer of material to the adhesive compositions which come into contact with them.

This object is achieved by a process for producing antiadhesive layers on a web-form material, as characterized more closely in the main claim. The subclaims relate to particularly advantageous embodiments of the process. The invention further embraces the use of the antiadhesive layers.

The invention accordingly provides a process for producing antiadhesive layers on a web-form material which are applied to the web-form material by means of low pressure plasma polymerization by guiding the web-form material continuously through a plasma zone containing a low pressure plasma.

Important process parameters which control the process of the deposition of the layers which are antiadhesive with respect to pressure-sensitive adhesive compositions and thus control the layer properties are the compounds used to form the low pressure plasma, and the carrier or the additional gases, the gas pressure or gas mixture pressure during the coating operation, and the electrical discharge which is used for plasma excitation. Varying the process parameters serves to optimize the layers which are antiadhesive with respect to pressure-sensitive adhesive compositions and to adapt them to the technical boundary conditions in the particular application case.

Coating is preferably carried out under a gas pressure or gas mixture pressure of from $10^{-3}$ to 20 mbar.

It is advantageous if the unwind station of the web-form material, the winding station and the plasma zone are located in a vacuum chamber (batch operation) or if the web-form material is guided through the plasma zone by means of vacuum locks, which is referred to as air-to-air operation.

The low pressure plasma is formed using in particular organosilicon compounds such as hexamethyl disiloxane, hexamethyldisilazane and/or tetraethyl orthosilicate, or perfluorinated hydrocarbons such as perfluorononane and/or perfluoropropene, or mixtures such as hexamethyldisiloxane with trifluoromethane and/or tetrafluoromethane.

Carrier gases or additional gases used are preferably unpolymerizable gases such as noble gases and/or nitrogen. Additional gases and carrier gases are used in order to control layer deposition and in particular to increase the uniformity and stability of the plasma.

Web-form materials used are preferably polymer films, foam backings, woven backings, nonwoven backings, or paper backings.

The use of the layers which are antiadhesive with respect to pressure-sensitive adhesive compositions, produced by means of the process of the invention, in connection with single-sided adhesive tapes for reducing adhesion, as a coating to the reverse face of the backing, has proven particularly advantageous. These layers are likewise particularly suitable on the release material which is used to line the adhesive coating.

Various forms of electrical discharge may be utilized for plasma excitation. It is preferably done by means of kHz, MHz or GHz discharge. Critical to the selection of the form of excitation are the technical boundary conditions—for example, necessary coating speed or gas mixture pressure during coating.

A particular advantage of the process in comparison to the prior art is the ability to control the process of layer deposition and thus the antiadhesive activity of the coatings with respect to pressure-sensitive adhesive compositions by varying the process parameters. This permits optimum adaptation of the layer properties to the particular application case.

A further advantage of the novel process is the avoidance of solvents and the possibility of avoiding the use of substances objectionable from a health or environmental standpoint.

An essential advantage of the layers which are antiadhesive with respect to pressure-sensitive adhesive compositions, produced by the process, is the fact that there is no transfer of material from the layer which is antiadhesive with respect to pressure-sensitive adhesive compositions to the adhesive composition which is brought into contact with it.

Moreover, the thermal load on the web-form materials is low owing to the low pressure plasma used, so that temperature-sensitive materials such as polyethylene, polypropylene or foams, in particular, may be coated without damage.

A further advantage is the high long-term stability of the novel layers which are antiadhesive with respect to pressure-sensitive adhesive compositions, since owing to the novel process these layers are highly crosslinked and thermally stable.

The antiadhesive coatings formed by means of plasma polymerization, especially for adhesive tape reverse faces and release materials, are accordingly produced without solvent, and exhibit no transfer of material with respect to pressure-sensitive adhesive compositions.

The intention of the text below is to depict particularly advantageous embodiments of the process of the invention without wishing unnecessarily to restrict this process.

Figure 1:
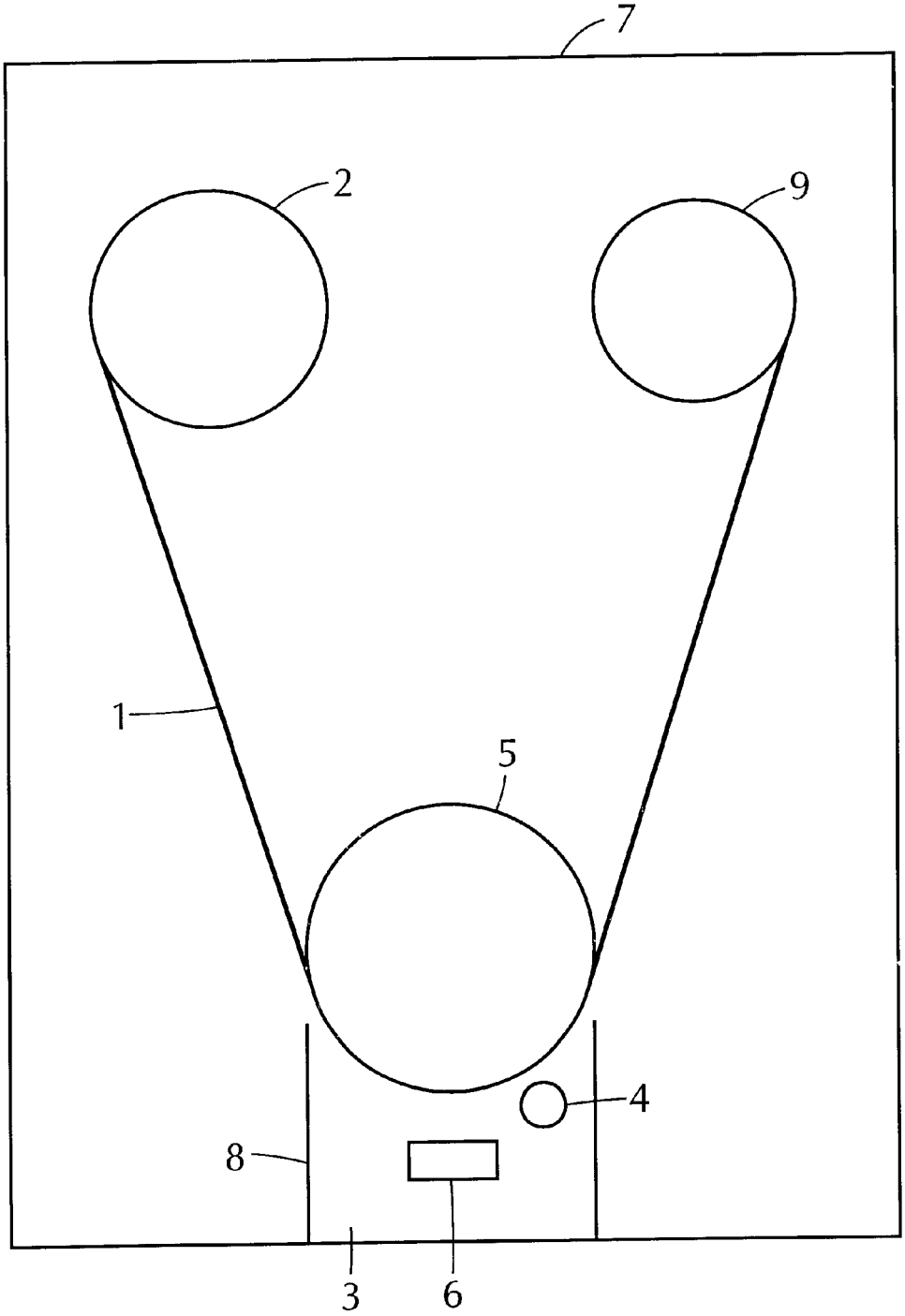
FIG. 1 shows the structure of a vacuum coating unit in accordance with the invention.

In accordance with FIG. 1, the web-form material 1 is moved from an unwind station 2 through the plasma coating zone 3. In the plasma coating zone 3, which is separated from the rest of the vacuum chamber 7 by boundaries 8, the compounds necessary to form the low pressure plasma are introduced by way of a supply 4. The plasma excitation and thus the fragmentation of the compounds takes place by way of a high-frequency alternating field which is applied between the electrodes 5 and 6. Electrode 5 is implemented as a grounded cooling roller and therefore serves at the same time to transport the web-form material 1. Finally, after coating, the web-form material 1 is supplied to a winding station 9.

Figure 2:
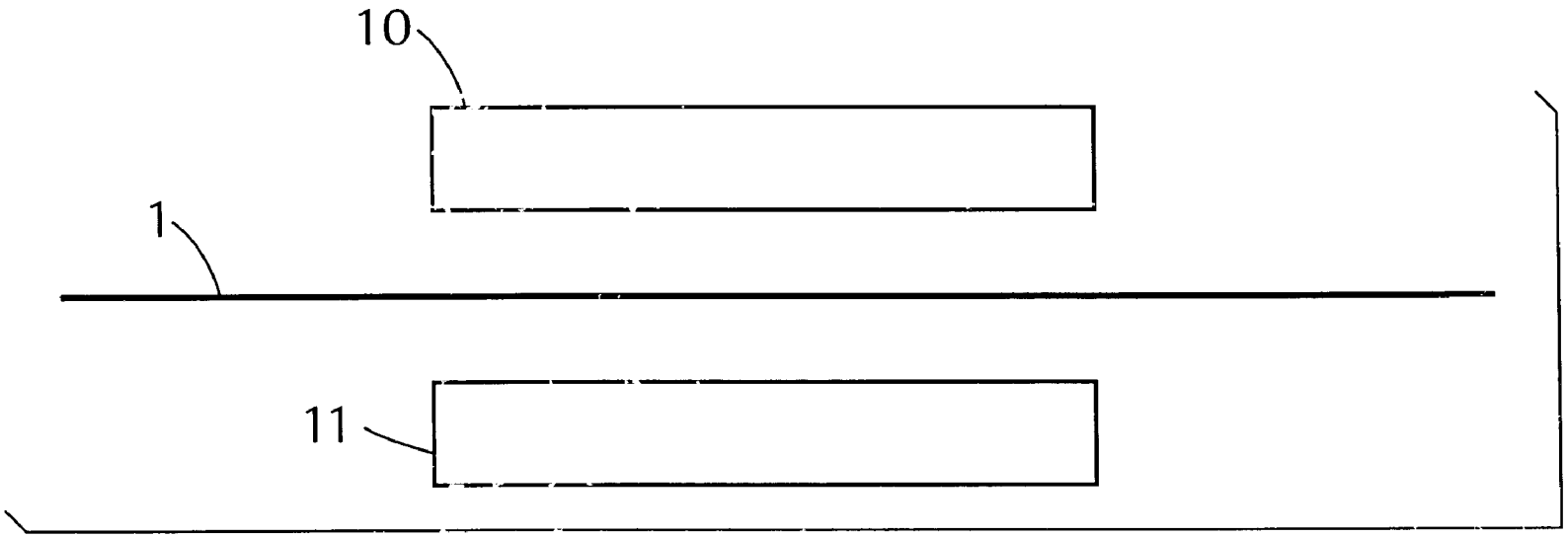
FIG. 2 shows an alternative arrangement of the electrodes from FIG. 1.

An alternative arrangement of the electrodes, 10 and 11, is shown in FIG. 2. In this figure, both electrodes 10 and 11 have been given a two-dimensional form, and the web-form material 1 is guided without contact through the electrode gap.

The selection of the respective electrode arrangement depends on the specific application case. In the case of plasma excitation by means of GHz discharge, the electrodes are to be replaced by means of corresponding GHz input connections.

Finally, the process of the invention is illustrated by way of example, here again without wishing to restrict the process unnecessarily.

EXAMPLE

A layer which is antiadhesive with respect to pressure-sensitive adhesive compositions is applied by means of low pressure plasma polymerization to a transparent polyester film 500 mm wide and with a thickness of 25 $\mu$m. Coating takes place in a unit corresponding to FIG. 1 with a hexamethyldisiloxane flow of 10 g/h at a process pressure of 1 mbar. The film is guided through the plasma zone (length 200 mm) at a rate of 10 m/min, giving a coating time of 1.2 s. Plasma excitation is by kHz discharge.

The quality of the layer which is antiadhesive with respect to pressure-sensitive adhesive compositions is investigated in a release force test. For this purpose, a double-sided test adhesive tape comprising a foamed backing and furnished with an acrylate pressure-sensitive adhesive composition is bonded in a width of 2 cm to the film provided with the inventively produced layer which is antiadhesive with respect to pressure-sensitive adhesive compositions, the tape is reinforced on the reverse face with a PVC film, and the system is subjected to rolling (80 mm diameter roller, 2 kg in weight, is rolled back and forth over the adhesive strip five times at approximately 10 m/min).

Testing of the release force between test adhesive tape and the layer which is antiadhesive with respect to pressure-sensitive adhesive compositions is carried out by means of a tensile force machine at a rate of 300 mm/min and at an angle of 180°. The release force between the test adhesive tape and the film provided inventively with a layer which is antiadhesive with respect to pressure-sensitive adhesive compositions is 0.25 N/cm. The antiadhesive activity in respect of pressure-sensitive adhesive compositions is in this example, therefore, below the range achieved using conventional carbamate lacquers and is as required on reverse faces of adhesive tape.

What is claimed is:

1. A process for producing antiadhesive layers on a web-form material, wherein the antiadhesive layers are applied to the web-form material by means of low pressure plasma polymerization by guiding the web-form material continuously through a plasma zone containing a low pressure plasma.

2. The process as claimed in claim 1, wherein coating is carried out at a gas pressure or gas mixture pressure of from $10^{-3}$ to 20 mbar.

3. The process as claimed in claim 1 wherein the low pressure plasma is generated by electrical discharge.

4. The process as claimed in claim 1, wherein the process is carried out using an unwind station and a winding station for the web-form material, and the unwind station of the web-form material, the winding station and the plasma zone are located in a vacuum chamber.

5. The process as claimed in claim 1, wherein the web-form material is guided through the plasma zone by means of vacuum locks.

6. The process as claimed in claim 1, wherein the low pressure plasma is formed using organosilicon compounds, perfluorinated hydrocarbons, or mixtures of organosilicon compounds with perfluorinated hydrocarbons.

7. The process as claimed in claim 1, wherein unpolymerizable gases are used as carrier gases or additive gases in the plasma zone.

8. The process as claimed in claim 1, wherein the web-form materials comprise polymer films, foam backings, woven backings, nonwoven backings, paper backings or a combination thereof.

* * * * *

UNITED STATES PATENT AND TRADEMARK OFFICE

CERTIFICATE OF CORRECTION

PATENT NO. : 6,444,274 B2
DATED : September 3, 2002
INVENTOR(S) : Olaf Gorbig

It is certified that error appears in the above-identified patent and that said Letters Patent is hereby corrected as shown below:

Title page, Item [54] and Column 1, lines 1 & 2,
Change "PRODUCTION OF ANTIADHESIVE COATINGS ON WEB FORM SUBSTRATES" to -- PRODUCTION OF ANTIADHESIVE COATINGS --

Signed and Sealed this

Twenty-fourth Day of December, 2002

JAMES E. ROGAN
*Director of the United States Patent and Trademark Office*